United States Patent [19]

Ioanesian et al.

[11] 4,453,604

[45] Jun. 12, 1984

[54] TURBODRILLS

[76] Inventors: Jury R. Ioanesian, ulitsa Matveevskaya 18 korpus 2, kv. 63, Moscow; Valery V. Popko, ulitsa Garshina, 9a, korpus 5, kv. 35, poselok Tomilino Moskovskoi oblasti; Radik S. Subkhangulov, Sevastopolsky prospekt, 83, korpus 1, kv. 51, Moscow, all of U.S.S.R.

[21] Appl. No.: 237,132

[22] PCT Filed: Jul. 27, 1979

[86] PCT No.: PCT/SU79/00059

§ 371 Date: Mar. 27, 1981

§ 102(e) Date: Feb. 6, 1981

[87] PCT Pub. No.: WO81/00428

PCT Pub. Date: Feb. 19, 1981

[51] Int. Cl.[3] ..... E21B 4/02

[52] U.S. Cl. ..... 175/107; 175/227; 277/29; 277/70; 415/502

[58] Field of Search ..... 175/107, 327, 227; 308/36.1; 418/104; 137/384; 277/29, 70; 415/502, 503

[56] References Cited

U.S. PATENT DOCUMENTS

| | | | |
|---|---|---|---|
| Re. 30,257 | 4/1980 | Fox | 175/107 |
| 1,896,706 | 2/1933 | Grimeo | 137/384 |
| 3,107,951 | 10/1963 | Palm | 308/36.1 |
| 3,133,603 | 5/1964 | Lagacherie et al. | 175/107 |
| 3,882,946 | 5/1975 | Ioannesian et al. | 175/107 |

FOREIGN PATENT DOCUMENTS

| | | | |
|---|---|---|---|
| 243534 | 9/1969 | U.S.S.R. . | |
| 121102 | 7/1975 | U.S.S.R. . | |
| 539135 | 12/1976 | U.S.S.R. | 175/107 |

*Primary Examiner*—James A. Leppink
*Assistant Examiner*—Hoang C. Dang
*Attorney, Agent, or Firm*—Lilling & Greenspan

[57] ABSTRACT

The turbodrill disclosed consists of a shell (1) attached to the drilling string and provided with an opening (3) in the side surface, a multistage turbine and a hollow shaft (6) supported in the shell (1) by radial bearings (10) and a thrust bearing (11). The bore (7) of the shaft (6) is hydraulically linked up with the drilling string (2) and with a space (15) provided above the nozzles of the bit (13). Seals (16, 17) keeping the drilling fluid out of the space (12) contained where the thrust bearings (11) are provided in an annular space between the shell (1) and the shaft (6).

The present invention can be used to advantage in turbodrills employed for the drilling of deep oil and natural gas wells under difficult geological conditions.

2 Claims, 5 Drawing Figures

TURBODRILLS

Field of the Invention

The present invention relates to drilling equipment and more specifically, to turbodrills.

Description of the Prior Art

A turbodrill used in prospecting for and developing oil and gas deposits occurring under complex geological conditions must meet certain requirements assuring its effective performance.

Firstly, said turbodrill must incorporate means of assuring positive control of the bit orientation in the course of drilling.

Secondly, the service life of the turbodrill must be sufficiently extended, contributing to a decrease in the operating costs.

The turbodrill in use nowadays employs the series pattern of drilling fluid flow movement. It comprises a shell, a solid shaft, a multistage turbine, radial and thrust bearings. The shell is attached to the drilling string, and the shaft carries a bit. The thrust bearing is separated from the drilling fluid by seals and is provided with a space filled with a lubricant. (Cf. USSR Inventor's Certificate No 373383 published Mar. 12, 1973 in a bulletin "Discoveries, Inventions, Industrial Samples and Trade Marks" No 14).

When the drilling fluid flows in accordance with the series pattern the entire flow of this fluid is fed into the multistage turbine where the differential pressure is developed, causing the rotation of the shaft integrally with the bit. The outflow of the drilling fluid from the multistage turbine is admitted into holes of the bit where the existing differential pressure is converted into an additional load coming on the seals provided in the space of the thrust bearing with the result that the rate of wear of said seals is speeded up.

Under the conditions of intensive drilling and also when the contact surfaces of the seals are of a rigid character, the lubricant contained in the space of the thrust bearing is consumed at a high rate. The bit quite frequently runs short of the lubricant before the drilling cycle is completed.

All attempts to obtain a reliable sealing effect by increasing the number of seals have proved to be of no avail because of a failure to ensure the specified distribution of the contact pressure the seals are exposed to.

Apart from that, the known turbodrill is incapable of assuring positive control of the bit orientation in the course of drilling, i.e., fails to meet an indispensable requirement.

A turbodrill wherein the flow of drilling fluid follows the parallel pattern dispenses with said disadvantage.

Said turbodrill incorporates a shell with an opening in its side surface, a multistage turbine and a shaft with a bore (Cf. USSR Inventor's Certificate No 121102 published in a bulletin "Discoveries, Inventions, Industrial Samples and Trade Marks" No 14, 1959 see page 6). Said shaft is supported by radial bearings and a thrust one which are arranged in the space between the shell and shaft.

The fact that the shaft is provided with a bore ensures positive control of the bit orientation in the course of drilling.

Yet the presence of the thrust bearing having a space filled with the drilling fluid containing abrasives is a factor bringing about rapid wear of said bearing.

Summary of the Invention

The main object of the present invention is to provide a turbodrill having a constructive unit adapted to reliably separate the space of the thrust bearing from the drilling fluid containing abrasives, owing to which the thrust bearing operates under conditions providing a slow rate of wear thereof.

Said and other objects are attained with the aid of a turbodrill the shell whereof has an opening in the side surface enabling the drilling fluid to escape therefrom and contains a multistage turbine with an inlet chamber hydraulically linked up with the drilling string and also with an outlet chamber connected to an annular space between the shell and the wall of the well by way of the opening in the shell and also contains a shaft which is provided with a bore and is supported inside said shell by radial bearings and thrust bearing; said shaft bore being hydraulically linked up with the drilling string as well as with a space available above the bit nozzles, said turbodrill being provided according to the invention with seals arranged in an annular space between the shell and shaft to keep the drilling fluid out of the thrust bearing space.

The sealing off of the space associated with the thrust bearing from the drilling fluid containing abrasives reduces the rate of wear of said bearing.

It is expedient to provide a lubricator between the seals along the axis of the shaft and to connect the bore of said lubricator filled with a lubricant to the thrust bearing space. If the pressure of the lubricant is maintained at least at the level of the ambient pressure, the drilling fluid will be kept out of the thrust bearing space.

It is also expedient to employ a seal comprising at least two contacting members one whereof is fitted to the shell and the other, to the shaft. The surface contact of the two members, one being stationary and the other capable of rotation, assures a reliable sealing effect between the shell and shaft.

It is further expedient to provide each contacting member in the form of a disc, this making for the compactness of the seal when this is being duplicated.

By virtue of making at least one of the contacting members in a resilient material it is possible to reduce the weight of the member and to enhance the vibration resistance.

As a result, the contacting member used is a compact one characterized by a permanent follow up which allows to maintain the contact without the recourse to some additional means.

It is preferred to provide at least one of the contacting members with a means of controlling the pressure of the lubricant contained in the thrust bearing space.

Said means will prevent the increase in pressure of the lubricant when it is heated in the thrust bearing space and consequently save components of the seal from damage when the turbodrill is in operation.

It is also preferred to provide the seals in the form of at least three contacting members locates successively along the axis of the shaft and forming a closed space communicating with the thrust bearing space through the means of controlling the pressure in this latter space, said means being fitted to at least one of the contacting members. The closed cavity formed by the three members serves to baffle the ingress of the drilling fluid into the space of the thrust bearing while the means of controlling the pressure distributes the contact pressure uniformly between the contacting members and maintains the pressure in said cavity space at the specified level. All the above factors contribute to the reliable performance of the seal.

The means of controlling the pressure can be provided in the form of a spring-loaded ball valve with calibrated spring force functioning as an accurate metering valve fitted with a gauged spring.

Brief Description of Drawings

A preferred embodiment of the present invention will now be described by way of an example with reference to the accompanying drawings in which.

Best Mode of Carrying the Invention into Effect

Figure 1:
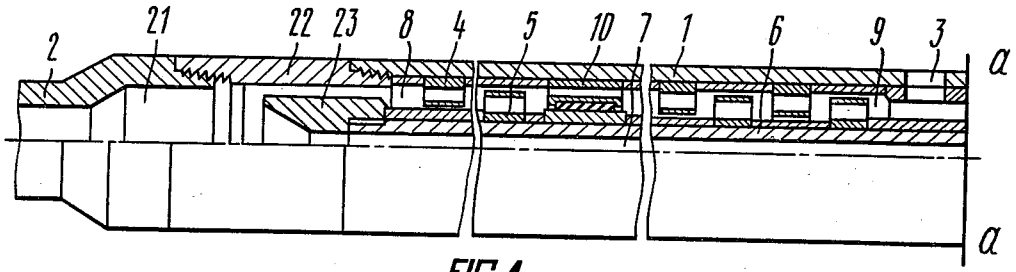
FIGS. 1 and 1' are partial longitudinal sections of the turbodrill according to the invention separated into two parts along the lines a—a and a'—a'.
Figure 1:
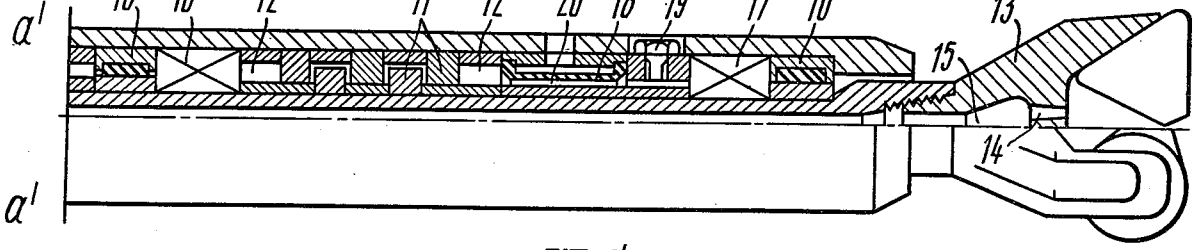

The turbodrill disclosed is illustrated in FIG. 1 as a single-section unit incorporating a shell 1 attached to the drilling string 2, pierced with an opening 3 enabling the outflow of the drilling fluid and containing a multistage turbine which is comprised of stators 4, rotors 5 and a shaft 6. The shaft 6 is provided with a bore 7, the stators 4 are secured in the shell 1 and the rotors 5 are attached to the shaft 6. At the entry into the multistage turbine there is provided an inlet chamber 8 and an outlet chamber 9 is provided downstream of the last stage of the multistage turbine. The turbodrill also incorporates radial bearings 10 and a thrust bearing 11 (FIG. 1') the parts of which form a space 12.

The radial bearings 10 serve to align the shaft 6 in the shell 1, and the thrust bearing 11 transmits axial loads from the shell 1 to the shaft 6 which carries a bit 13. The bit 13 is provided with holes 14 through which the drilling fluid outflows into the bottom hole and a space 15 is provided in the bit above said holes 14.

The thrust bearing space 12 is isolated from the drilling fluid by seals 16 and 17, and interposed between the seals 16 and 17 are a lubricator 18 as well as an oil filler 19. A bore 20 inside the lubricator 18 which is filled with a lubricant communicates with the space 12 of the thrust bearing 11.

The bore 21 of the drilling string 2 (FIG. 1) communicates with the inlet chamber 8 and the bore 7 of the shaft 6. The outlet chamber 9 is connected to the opening 3 and the space 15 in the bit 13 is connected to the bore 7 of the shaft 6.

The stators 4 are secured in the shell 1 with the aid of an adapter 22 and the rotors 5 are held fast to the shaft 6 by a nut 23.

Figure 2:
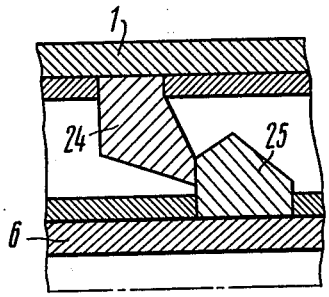
FIG. 2 is a longitudinal section of a portion of the turbodrill illustrating seals according to the invention in the form of contacting members.

The seals 16 and 17 each consists of two contacting members 24 (FIG. 2) and 25, one of them shown at 24 being fitted to the shell 1 and the other, shown at 25, being attached to the shaft 6.

The spaces 12 and 20 are filled, say with oil, through the oil filler 19 (FIG. 1').

Figure 3:
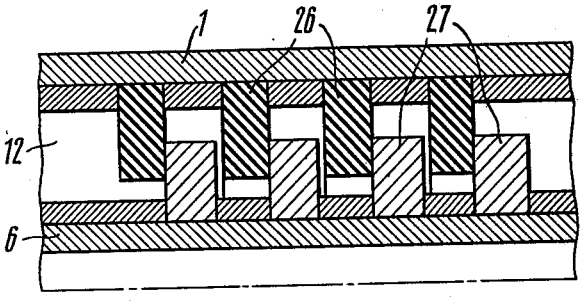
FIG. 3 is a longitudinal section of a portion of the turbodrill illustrating seals with contacting members in the form of discs some of which are made in a resilient material.

Illustrated in FIG. 3 is an embodiment of the seals 16 and 17 wherein the contacting members are discs 26 and 27, those shown at 26 being made from a resilient material.

Figure 4:
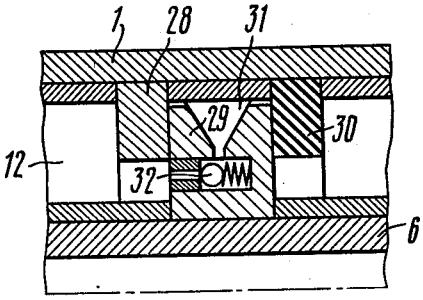
FIG. 4 is a longitudinal section of a portion of the turbodrill with seals made up of three successively contacting members forming a closed cavity, one of said members being fitted with a means of controlling pressure.

It is expedient to use a seal consisting of three members as this is shown in FIG. 4 where three successively contacting members 28, 29, 30 are fitted along the axis of the shaft 6 so as to form a closed cavity 31.

The member 29 is provided with a means of controlling pressure which is a spring-loaded ball valve 32.

The cavity 31 communicates with the space 12 of the thrust bearing 11 by way of the spring-loaded ball valve 32.

The turbodrill disclosed operates in the following way. The drilling fluid fed by mud pumps (not shown) is delivered through the drilling string 2 (FIGS. 1 and 1') into the adapter 22 where it is split into two parallel flows.

One of the flows is admitted into the inlet chamber 8 and, on passing through the multistage turbine where the differential pressure is being developed, enters the outlet chamber 9 wherefrom it leaves into the annular space of the well (not shown) through the opening 3.

The other of the parallel flows is introduced into the space 15 of the bit 13 through the bore 7 of the shaft 6 where the differential pressure is being developed in the holes 14 of the bit 13.

The differential pressure developed in the holes 14 of the bit 13 is the same as the differential pressure developed in the multistage turbine consisting of the stators 4 and the rotors 5. The rotors 5 cause the shaft 6 to rotate integrally with the bit 13.

As it will be noted from FIG. 1, by virtue of separating the drilling fluid into two parallel flows the seal 16 is relieved of the differential pressure developed in the holes 14 of the bit 13 and, consequently, the drilling fluid flows out through the opening 3 provided upstream of the seal 16 by-passing the space 12 of the thrust bearing 11.

At the same time, the lubricator 18 creates back pressure acting on both seals 16 and 17, keeping thereby the drilling fluid outside the spaces 12 and 20.

Should the pressure of the lubricant in the spaces 12 and 20 change for some reason or other, the means of controlling pressure interfere, adjusting the pressure in the closed cavity 31 so as to assure the specified distribution of the contact pressure acting on the seals.

In the event of vibration of the turbodrill, the seals 16 and 17 made in a resilient material provide for the sealing off of the spaces 12 and 20 from the drilling fluid in the most reliable way.

All in all, the above factors ensure reliable protection of the thrust bearing space against the ingress of the drilling fluid and provide for an extended service life of the turbodrill.

In addition to that embodiment of the invention wherein the rotary part of the turbodrill is its shaft, it is feasible to operate the turbodrill with the rotating shell. In this case, the shaft of the turbodrill is attached to the drilling string and the shell carries the bit, the stators functioning as the rotors and vice versa. No alterations are required.

This embodiment of the turbodrill makes it possible to bring various devices through the drill pipes and shaft bore 7 down to the bit nozzles without withdrawing the turbodrill, for example so as to determine the bottom hole coordinates, with the advantage that all the measurements are taken directly in the bit operating zone.

Industrial Applicability

It can be used to advantage in turbodrills used to drill deep oil and gas wells under difficult geological conditions and in those intended for directional drilling.

What is claimed is:

1. A turbodrill comprising a shell with an opening in the side surface thereof enabling the drilling fluid to pass, a multistage turbine contained in said shell and provided with an inlet chamber and an outlet chamber, said inlet chamber being hydraulically linked up with a drill string, said outlet chamber communicating with an annular space between said shell and the wall of the well by way of said opening in said shell; a hollow shaft supported in said shell by radial bearings and a thrust bearing, the bore of said shaft being hydraulically linked up with the drill string and with a space provided above bit nozzles characterized in that seals (16, 17) are provided in the annular space between said shell (1) and said shaft (6) to seal off the space (12) of the thrust bearing (11) from the drill fluid, every one of said seals being made up of at least three members (28, 29, 30) fitted along the axis of said shaft (6) and successively contacting each other to form a closed cavity (31) communicating with said thrust bearing space (12); means (32) of controlling the pressure of lubricant contained in said thrust bearing space, said means (32) being fitted to at least one of said contacting members (29).

2. A turbodrill comprising a shell with an opening in the side surface thereof for the passage of the drilling fluid, a multistage turbine contained in said shell and provided with an inlet chamber hydraulically communicating with the drill string and an outlet chamber communicating with the external space by way of said opening in said shell, a hollow shaft supported in said shell by radial bearings and a thrust bearing, the bore of said shaft hydraulically communicating with the drill string and with a space provided above bit nozzles, seals provided in the annular space between said shell and said shaft to seal off the space of the thrust bearing from the drilling fluid, each of said seals incorporating members contacting each other and including at least one means of controlling the pressure of lubricant contained in said thrust bearing space, characterized in that each said seal is made up of at least three members mounted along said shaft and successively contacting each other, which members form a closed cavity communicating with said thrust bearing space by way of said means of controlling pressure in the latter space, said means being placed in at least one of said contacting members.

* * * * *